US009418561B2

(12) United States Patent
Gannon et al.

(10) Patent No.: US 9,418,561 B2
(45) Date of Patent: Aug. 16, 2016

(54) SYSTEM AND METHOD FOR DISPLAYING PREDICTIVE CONFORMAL CONFIGURATION CUES FOR EXECUTING A LANDING

(71) Applicant: HONEYWELL INTERNATIONAL INC., Morristown, NJ (US)

(72) Inventors: Aaron Gannon, Anthem, AZ (US); Ivan Sandy Wyatt, Scottsdale, AZ (US); Thea L. Feyereisen, Hudson, WI (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 55 days.

(21) Appl. No.: 14/558,067

(22) Filed: Dec. 2, 2014

(65) Prior Publication Data

US 2016/0155341 A1 Jun. 2, 2016

(51) Int. Cl.
*G08G 5/00* (2006.01)
*G08G 5/02* (2006.01)

(52) U.S. Cl.
CPC ..... *G08G 5/0056* (2013.01); *G08G 5/025* (2013.01)

(58) Field of Classification Search
CPC ..... G08G 5/0056; G08G 5/025
USPC ..... 701/16
See application file for complete search history.

(56) References Cited

U.S. PATENT DOCUMENTS

| | | | | |
|---|---|---|---|---|
| 6,389,333 | B1 * | 5/2002 | Hansman | G01C 23/00 701/14 |
| 7,026,956 | B1 | 4/2006 | Wenger et al. | |
| 7,908,082 | B2 * | 3/2011 | Clark | G08G 5/0021 340/961 |
| 8,386,097 | B2 * | 2/2013 | de Menorval | G08G 5/0052 340/969 |
| 8,442,707 | B2 | 5/2013 | Ledesma et al. | |
| 8,589,071 | B2 | 11/2013 | Feyereisen et al. | |
| 2008/0162092 | A1 | 7/2008 | Coulmeau et al. | |

OTHER PUBLICATIONS

Ngoc, L.L.; The Effect of Synthetic Vision Enhancements on Landing Flare Performance; AIAA Guidance, Navigation, and Control Conference Aug. 2-5, 2010, Toronto, Ontario Canada.
Extended EP Search Report for Application No. 15196390.7-1803 dated Apr. 5, 2016.

* cited by examiner

*Primary Examiner* — Richard Camby
(74) *Attorney, Agent, or Firm* — Ingrassia Fisher & Lorenz, P.C.

(57) ABSTRACT

A system and method for displaying predictive cues on an aircraft display system for executing a landing after an engine failure is provided. The system and method displays the cues for various aircraft configurations, and each cue is displayed in perspective (conformally) on a three dimensional graphical display of the surrounding terrain.

20 Claims, 6 Drawing Sheets

SYSTEM AND METHOD FOR DISPLAYING PREDICTIVE CONFORMAL CONFIGURATION CUES FOR EXECUTING A LANDING

TECHNICAL FIELD

Embodiments of the subject matter described herein relate generally to avionics flight display systems and, more particularly, to a flight display system that displays predictive conformal configuration cues for executing a landing after an aircraft engine failure.

BACKGROUND

The spectrum of flight operations includes routine operations, such as take-off, en route cruising, landing, and taxiing, as well as anticipated non-routine operations. An example of an anticipated non-routine operation is an engine failure operation. As used herein, "engine failure" includes a plurality of events that result in the aircraft losing thrust from the engine, such as fuel exhaustion, routine practice operations, bird or debris interference, and mechanical or electrical failures. The aforementioned flight operations are supported by aircraft design features, pilot training, and an on-board avionics display system.

Aircraft design features assure that modern single engine aircraft are able to glide to a safe landing in the event of an engine failure. Without the thrust from the engine, the aircraft is flown at the best glide airspeed, and with sufficient altitude, the pilot may turn the aircraft around, locate an airfield, and execute a controlled and safe landing. In order to execute the safe glide landing, pilots are trained to make various aircraft configuration changes, such as deploying flaps, deploying or extending landing gear, and, in the case of a single engine plane, feathering the propeller. Each of these configuration changes affects glide speed and the lift-to-drag ratio of the aircraft, therefore each configuration may cause the landing to occur at a different location.

Although modern avionics display systems display a considerable amount of useful information, such as vehicle position, speed, altitude, attitude, navigation, target, and terrain information, and the like, predictive assistance to pilots during a glide landing is desirable. Specifically, visual guidance that cues or informs a pilot of the predicted landing sites resulting from various potential aircraft configurations is needed.

Accordingly, a system and method for displaying predictive cues on an aircraft display system for executing a landing after an engine failure is desirable. It would further be desirable if the system and method displayed cues for a variety of aircraft configurations, and displayed the cues in perspective (conformally) on a three dimensional graphical display of the surrounding terrain.

BRIEF SUMMARY

This summary is provided to introduce a selection of concepts in a simplified form that are further described below in the detailed description section. This summary is not intended to identify key features or essential features of the claimed subject matter, nor is it intended to be used as an aid in determining the scope of the claimed subject matter.

A method for displaying, on an avionics display system, cues for executing an aircraft landing after an engine failure is provided. The method comprises receiving avionics data and processing the avionics data to (i) determine current aircraft configuration, (ii) predict a first landing site based on the current aircraft configuration, and (iii) predict a second landing site associated with altering the current aircraft configuration. The method also comprises displaying a first cue representative of the first landing site and a second cue representative of the second landing site.

An avionics display system is also provided. The avionics display system comprises a flight deck display coupled to receive display commands and is configured, upon receipt thereof, to render images. The avionics display system also comprises a processor operatively coupled to the flight deck display and adapted to receive avionics data, the processor is configured, upon receipt of the avionics data, to (i) determine current aircraft configuration, (ii) predict a first landing site based on the current aircraft configuration, (iii) predict a second landing site associated with an alternate aircraft configuration, and (iv) supply display commands to the flight deck display that cause the flight deck display to render a first cue representative of the first landing site and a second cue representative of the second landing site.

Another method for displaying, on an avionics display system, configuration cues for executing a single engine aircraft landing after engine failure is provided. The method comprises receiving avionics data and processing the avionics data to (i) determine the terrain, (ii) determine current aircraft lift-to-drag ratio, (iii) predict a first landing site based on the current aircraft lift-to-drag ratio, (iv) predict a second landing site associated with a first alteration in the aircraft lift-to-drag ratio, and (v) predict a third landing site associated with a second alteration in the aircraft lift-to-drag ratio.

Other desirable features will become apparent from the following detailed description and the appended claims, taken in conjunction with the accompanying drawings and background.

BRIEF DESCRIPTION OF THE DRAWINGS

A more complete understanding of the subject matter may be derived by referring to the following detailed description and claims when considered in conjunction with the following figures, wherein like reference numbers refer to similar elements throughout the figures.

DETAILED DESCRIPTION

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

Techniques and technologies may be described herein in terms of functional and/or logical block components and with reference to symbolic representations of operations, processing tasks, and functions that may be performed by various computing components or devices. Such operations, tasks, and functions are sometimes referred to as being computer-executed, computerized, software-implemented, or computer-implemented. In practice, one or more processor devices can carry out the described operations, tasks, and functions by manipulating electrical signals representing data bits at memory locations in the system memory, as well as other processing of signals.

The memory locations where data bits are maintained are physical locations that have particular electrical, magnetic, optical, or organic properties corresponding to the data bits. It should be appreciated that the various block components shown in the figures may be realized by any number of hardware, software, and/or firmware components configured to perform the specified functions. For example, an embodiment of a system or a component may employ various integrated circuit components, e.g., memory elements, digital signal processing elements, logic elements, look-up tables, or the like, which may carry out a variety of functions under the control of one or more microprocessors or other control devices.

The system and methods described herein can be deployed with any aircraft. The embodiments of the system and methods described herein represent an intelligent way to present visual guidance to a pilot or flight crew during a landing operation of an aircraft that has experienced engine failure.

Figure 1:
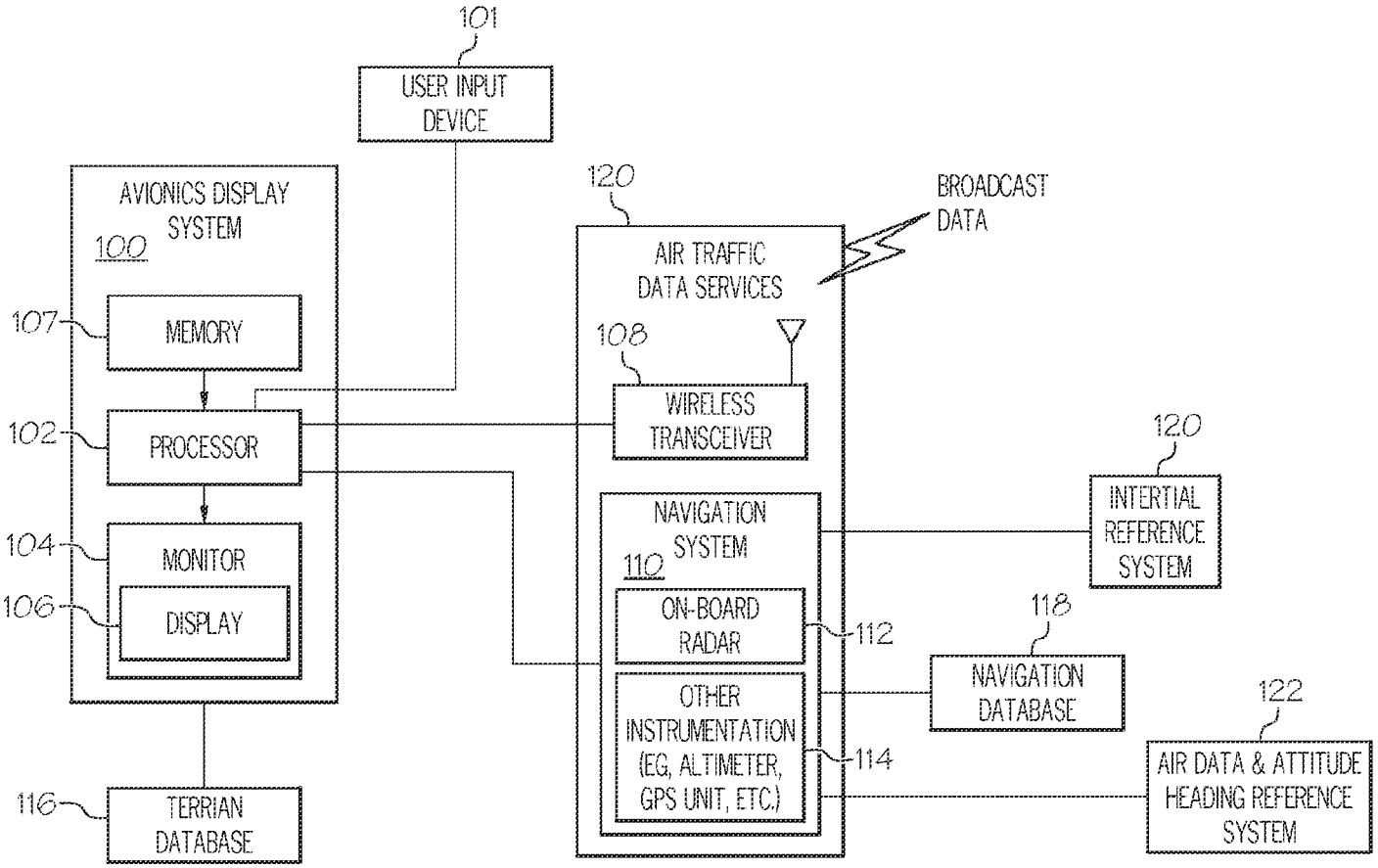
FIG. 1 is a schematic representation of an embodiment of a avionics display system.

FIG. 1 is functional block diagram illustrating an avionics display system 100 in accordance with an exemplary embodiment. Avionics display system 100 includes at least one processor 102, at least one monitor 104, memory 107, and a user input device 101, each of which is operatively coupled to processor 102. During operation of avionics display system 100, processor 102 drives monitor 104 to produce a display 106 that visually provides a pilot and crew with a composite of navigation information pertaining to the host aircraft, weather, navigational aids (NAVAID), terrain, and aircraft traffic. Processor 102 may provide the display 106 with a composite image in a two dimensional format (e.g., as a moving map display), or a three dimensional format (e.g., as a perspective display), or in a hybrid format (e.g., in a picture-in-picture or split screen arrangement).

Processor 102 may comprise, or be associated with, any suitable number of individual microprocessors, flight control computers, navigational equipment, memories, power supplies, storage devices, interface cards, and other standard components known in the art. Processor 102 may be included within a Flight Management Computer of the type commonly deployed within a Flight Management System (FMS).

The processor 102 may include or cooperate with an appropriate amount of memory 107 which can be realized as RAM memory, flash memory, EPROM memory, EEPROM memory, registers, a hard disk, a removable disk, a CD-ROM, or any other form of storage medium known in the art. In this regard, the memory 107 can be coupled to the processor 102 such that the processor 102 can read information from, and write information to, memory 107. In this respect, the processor 102 may include or cooperate with any number of software programs (e.g., avionics display programs) or instructions designed to carry out the various methods, process tasks, calculations, and control/display functions described below. In the alternative, memory 107 may be integral to the processor 102. In practice, a functional or logical module/component of the system described here might be realized using program code that is maintained in memory 107, such as configuration data and models. Moreover, memory 107 can be used to store data utilized to support the operation of the system, as will become apparent from the following description.

Image-generating devices suitable for use as monitor 104 include various analog (e.g., cathode ray tube) and digital (e.g., liquid crystal, active matrix, plasma, etc.) display devices. In certain embodiments, monitor 104 may assume the form of a Head-Down Display (HDD) or a Head-Up Display (HUD) included within an aircraft's Electronic Flight Instrument System (EFIS). Monitor 104 may be disposed at various locations throughout the cockpit. For example, monitor 104 may comprise a primary flight display (PFD) and reside at a central location within the pilot's primary field-of-view. Alternately, monitor 104 may comprise a secondary flight deck display, such as an Engine Instrument and Crew Advisory System (EICAS) display, mounted at a location for convenient observation by the aircraft crew but that generally resides outside of the pilot's primary field-of-view. In still further embodiments, monitor 104 may be worn by one or more members of the flight crew.

In the exemplary embodiment illustrated in FIG. 1, the air traffic data sources 120 include a wireless transceiver 108 and a navigation system 110, which are operatively coupled to first and second inputs of processor 102, respectively. Navigation system 110 may be coupled to an inertial reference system (IRS) 120, air data and attitude heading reference system (ADAHRS) 122, and a navigation database 118; navigation system 110 also typically includes onboard radar 112 and onboard instrumentation 114, such as a radio altimeter, a barometric altimeter, a global positioning system (GPS) unit, and the like. Navigation system 110 may be included within a FMS, and onboard radar 112 may be included within a Terrain Awareness and Warning System (TAWS), such as an Enhanced Ground Proximity Warning System (EGPWS). Wireless transceiver 108 is considered an air traffic data source in that wireless transceiver 108 receives broadcast data from external control sources and relays this data to processor 102.

The terrain database 116 includes various types of data, including runways, areas that could be used as runways, elevation data, and other information representative of the terrain over which the aircraft is flying. The terrain data can be used to generate a three dimensional perspective view of terrain in a manner that appears conformal to the earth. In other words, the display 106 emulates a realistic view of the terrain from the flight deck or cockpit perspective. The data in the terrain database 116 can be pre-loaded by external data sources or provided in real-time by terrain sensors (not shown).

Processor 102 includes one or more inputs operatively coupled to one or more avionics data sources, which continually provide processor 102 with data input from user input device 101, terrain database 116, and air traffic data services 120. In operation, an avionics display system 100 as described herein is suitably configured to process the current real-time avionics data (such as geographic position data, current real-time heading data, airport feature data, aircraft body mass acceleration data, configuration data, terrain data, and the like) to generate image rendering display commands to achieve the display 106.

Figure 2:
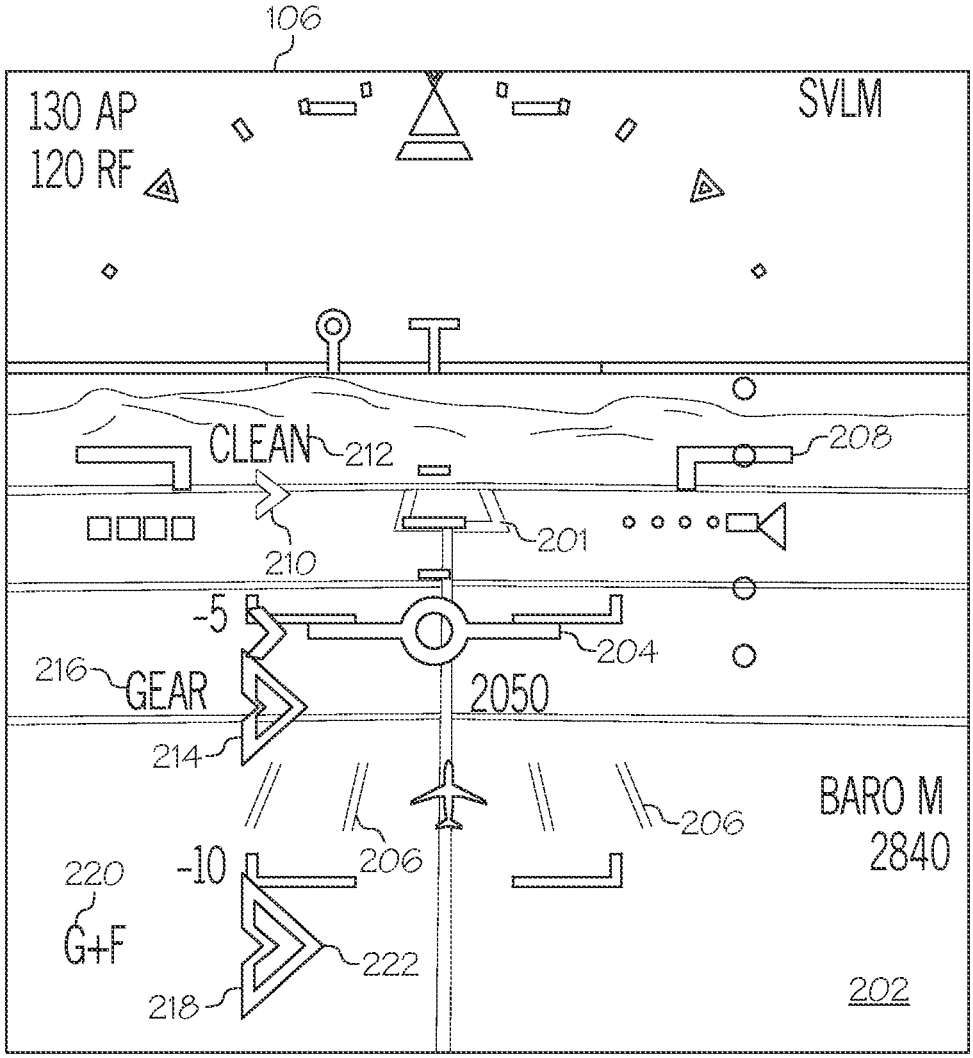
FIG. 2 illustrates a typical aircraft display system graphic with a 3D graphical display in accordance with an exemplary embodiment.

FIG. 2 illustrates a typical aircraft display system graphic of a 3D graphical display 106 in accordance with an exemplary embodiment. Pilots rely on 3D graphical displays such as display 106 to depict target runways, such as runway 201, and surrounding terrain. Graphical displays such as display 106 provide relevant, time sensitive information; for example, flight path marker 204 depicts the direction of travel, lateral and wind drift information 206, and flight path marker 208, indicates the direction that the aircraft is traveling.

At the moment of detecting the engine failure, the exemplary embodiment determines performance computations based on temperature, pressure, altitude, real time lift-to-drag ratio, aircraft weight, and aircraft configuration information. Responsive to the performance computations, the exemplary embodiment adds simple, unique, predictive conformal cues (symbols 210, 214 and 218) to the display 106. The predictive conformal cues inform the pilot of potential landing sites associated with alterations in the aircraft lift-to-drag ratio. The alterations in the aircraft lift-to-drag ratio may be predetermined configurations of aircraft equipment (for example, landing gear, flaps, spoilers, and the like) that alter the lift-to-drag ratio, or they may be aircraft maneuvers (for example, a slip). Alternate aircraft configuration data is stored in memory 107 and may be customized via user input at user input device 101. Each cue, described hereinbelow, is predictive as to the location that the aircraft will land (a landing site) for a given configuration of aircraft equipment. Each cue is unique in its combination of a symbol and associated text.

Symbol 210 is shown as a chevron with its point at the predicted best landing site, runway 201, and the text "clean" 212 is displayed proximate to symbol 210. Typically, the best or "clean" landing site is also the landing site associated with the "current" aircraft configuration and lift-to-drag ratio. Regardless of the current configuration, landing at the best or "clean" landing site is typically accomplished when the pilot does not alter the aircraft configuration (i.e., does not extend the landing gear or deploy flaps), and aligns the flight path marker 204 with the "clean" chevron (symbol 210), extending the glide of the aircraft as much as possible and achieving the maximum lift-to-drag ratio (L/D) for the aircraft. As previously mentioned, altering the L/D may also comprise an aircraft maneuver, like a slip.

Symbol 214 is a chevron pointing to the predicted landing site that would result if the pilot altered the aircraft lift-to-drag ratio by deploying/extending only the landing gear. The optionally selected text "gear" 216 is displayed proximate to symbol 214. In the exemplary embodiment, the location of symbol 214 is continuously being updated and displayed to reflect a landing site that results from deploying the landing gear. Likewise, symbol 218 is a chevron pointing to a predicted landing site that would result if the pilot altered the aircraft lift-to-drag ratio by deploying both landing gear and flaps. The optionally selected text "G+F" 220 is displayed proximate to symbol 218. The location of symbol 218 is also continuously updated and displayed to reflect a landing site that results from deploying the landing gear and flaps. The symbols 210, 214 and 218 are optionally illustrated as chevrons, and oriented so that the point (for example, point 222) is located on the landscape 202 at the location of the predicted landing site for the associated configuration of the aircraft.

The symbols 210, 214 and 218 are rendered in perspective form (also referred to as "conformal") on the landscape, which is reflected in the relative size decrease from symbol 218 to symbol 214, to symbol 210. In other words, symbol 218 is more near to the aircraft and symbol 210 is farther away from the aircraft. The symbols may be visually distinguishable by means of various techniques, such as highlighting, color variations, flashing, etc.; symbols, text labels and visual distinguishability techniques may be customized via user input at the user input device 101 during any part of the flight or landing operation.

Figure 3:
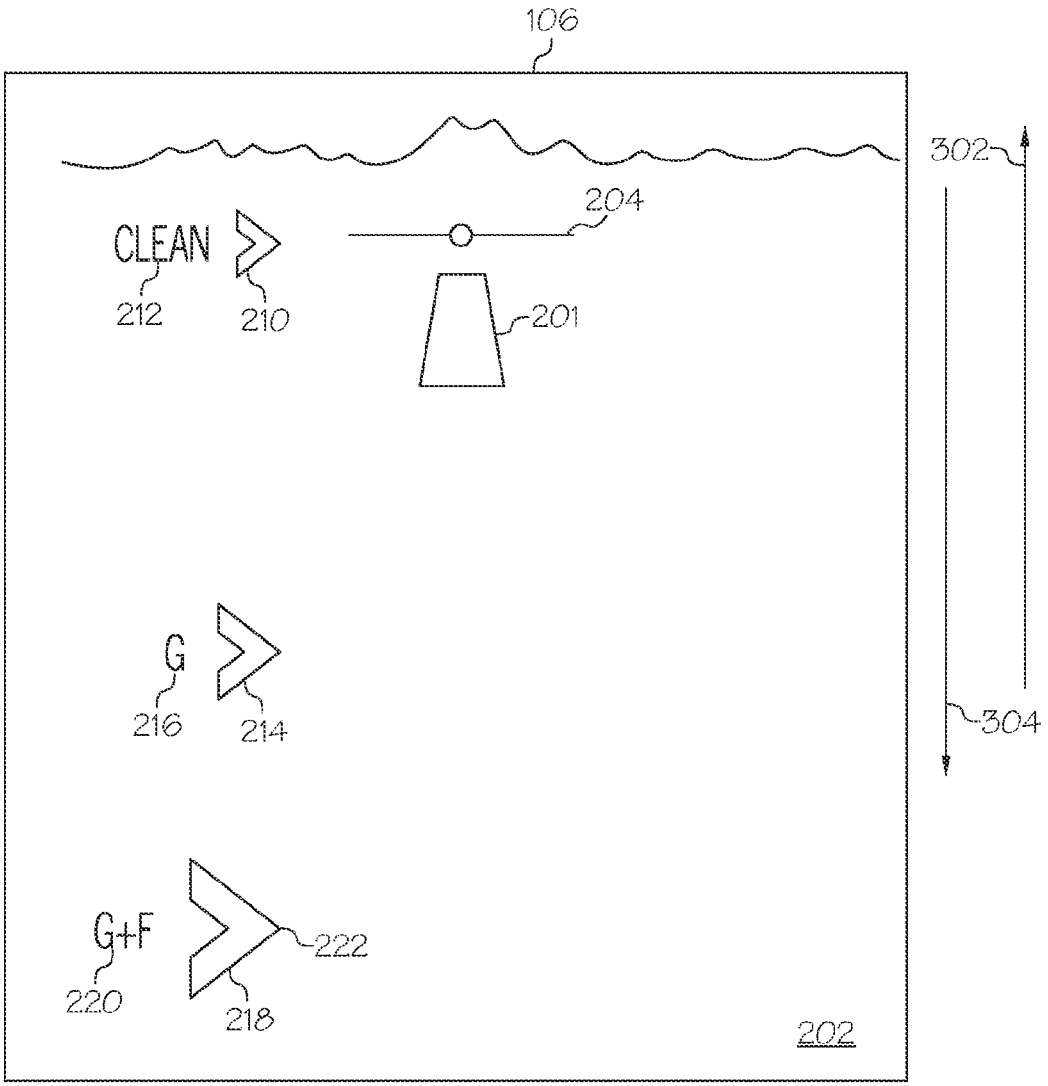
FIG. 3 is a simplified illustration of the 3D graphical display of FIG. 2, in accordance with the exemplary embodiment.
Figure 4:
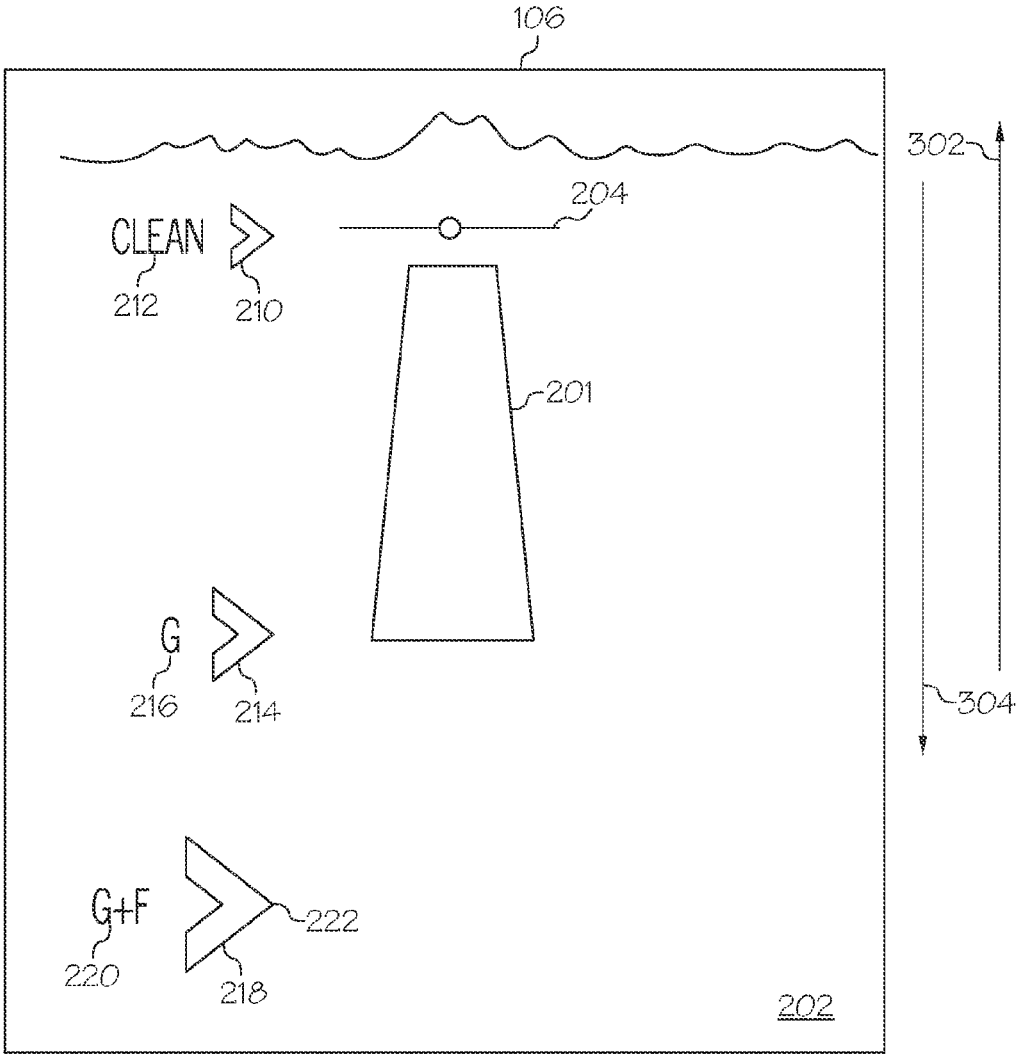
FIG. 4 is a simplified illustration of the 3D graphical display of FIG. 3 after some time has elapsed, in accordance with the exemplary embodiment.
Figure 5:
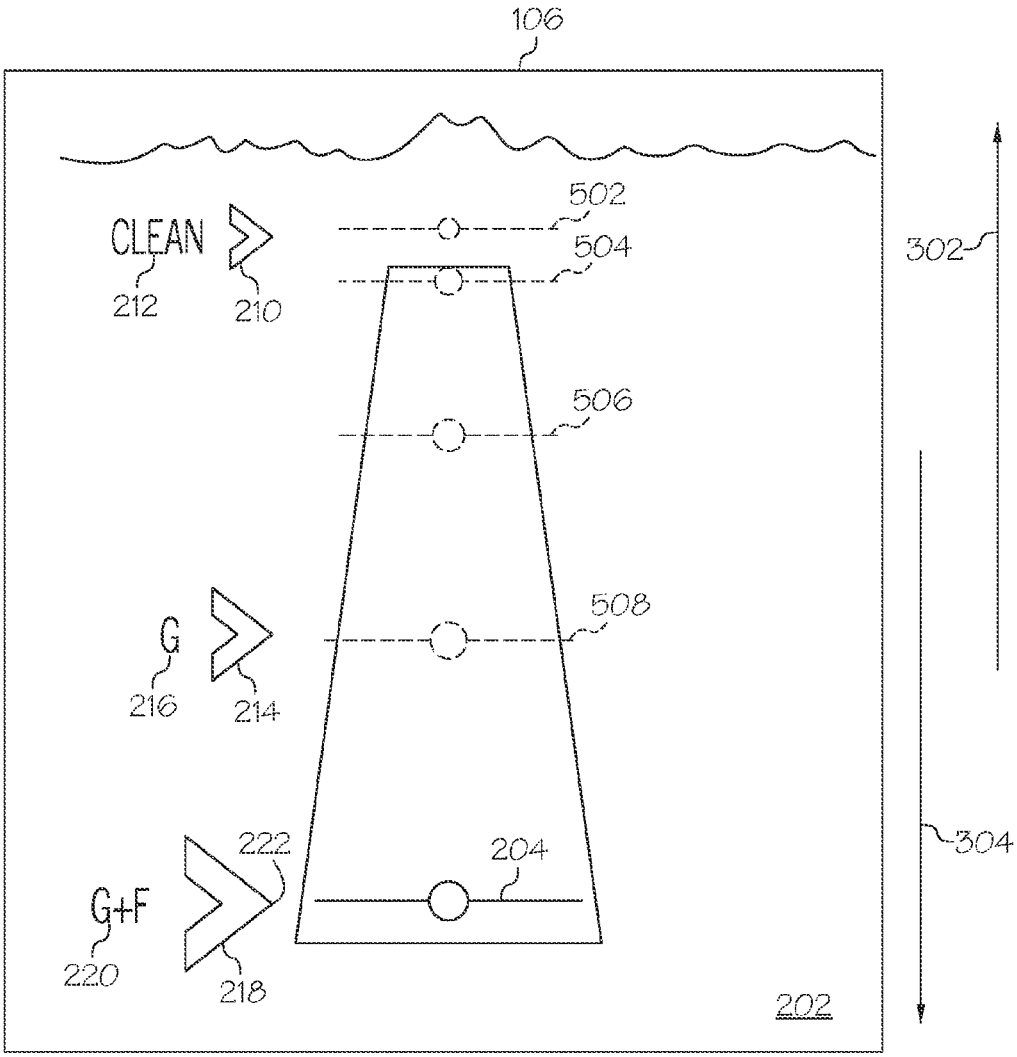
FIG. 5 is a simplified illustration of the 3D graphical display of FIG. 4 after more time has elapsed, in accordance with the exemplary embodiment.

Using the exemplary embodiment, the pilot, without reducing the lift-to-drag ratio of the aircraft, aligns the flight path marker 204 with the "clean" chevron to affect aircraft movement toward runway 201. As the aircraft moves closer to runway 201, the runaway appears larger on display 106. At the point in time when runway 201 is even with, or slightly overlapped with, the "G+F" chevron, symbol 218 on display 106, the pilot decreases the lift-to-drag ratio (for example, lowers the gear and flaps), and aligns the flight path marker 204 with the "G+F" chevron, symbol 218. FIGS. 3, 4 and 5 illustrate these concepts in more detail.

FIG. 3 is a simplified illustration of the 3D graphical display of FIG. 2, in accordance with the exemplary embodiment. FIG. 3 is not to scale, but may be relied upon to understand the relative size and locational relationships of the objects. The flight path marker 204 is aligned with the "clean" chevron, symbol 210. Aircraft travel is in the direction of arrow 302. The terrain appears to move in the direction of arrow 304.

FIG. 4 is a simplified illustration of the 3D graphical display of FIG. 3 after some time has elapsed, in accordance with the exemplary embodiment. Flight path marker 204 is aligned with the "clean" chevron, symbol 210. The aircraft has flown closer to runway 201, resulting in runway 201 appearing larger.

FIG. 5 is a simplified illustration of the 3D graphical display of FIG. 4 after more time has elapsed, in accordance with the exemplary embodiment. At the point when runway 201 is slightly overlapped with the "G+F" chevron, symbol 218, the pilot alters the lift-to-drag ratio by, for example, deploying the gear and flaps, and lands. The pilot lowers the flight path marker 204 from its initial position 502 to align it with the "G+F" chevron, symbol 218, thereby moving flight path marker 204 through position 504, position 506, and position 508 before bringing it to rest in alignment with the "G+F" symbol 218.

Figure 6:
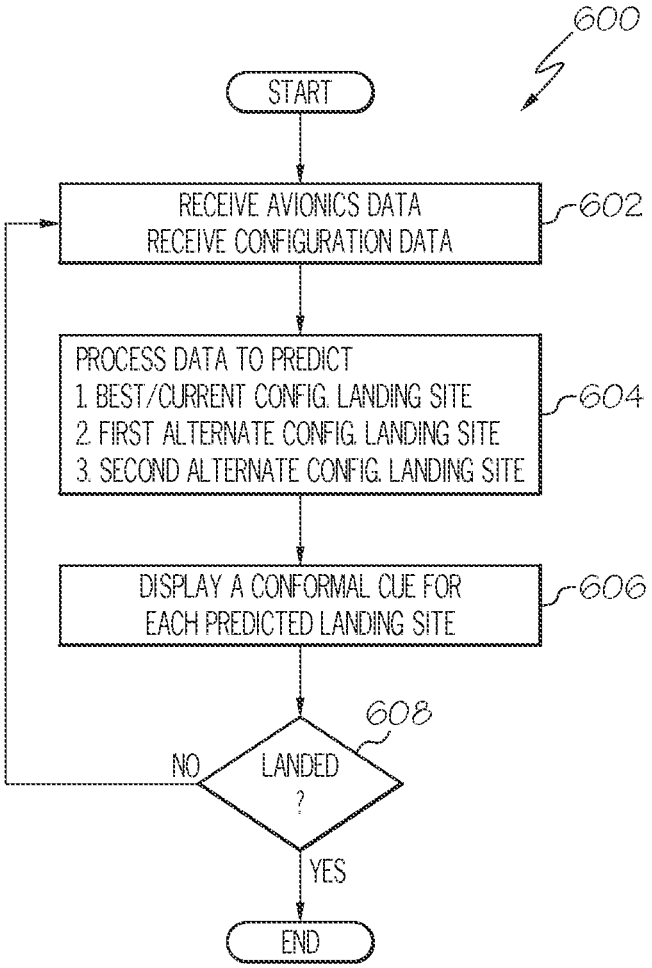
FIG. 6 flow chart that illustrates an exemplary embodiment of a process for displaying predictive conformal configuration cues.

FIG. 6 is a flow chart that illustrates an exemplary embodiment of a process 600 for displaying predictive conformal configuration cues. While STEP 602-STEP 608 are arbitrarily shown as occurring in a sequence, in practice, these steps may be rearranged, customized, or have additional steps added. In addition, user input that customizes symbol shapes, symbol colors, text for aircraft configurations, techniques for displaying the objects in a visually distinguishable manner, and the like, may be accepted at any step in process 600. Typically, at the moment of detecting the engine failure, the aircraft does not have landing gear extended and does not have flaps deployed; therefore, when process 600 starts, the "current" aircraft configuration and associated lift-to-drag ratio is generally referred to as the configuration that would lead to a "best" or "clean" landing site. The details are described in more detail hereinbelow.

At STEP 602 avionics data (such as geographic position data, current real-time heading data, airport feature data, aircraft body mass acceleration data, configuration data, terrain data, and the like) is received by process 600. Avionics data also includes related data from aircraft subsystems such as wireless transceiver 108, navigation system 110, terrain data, and the various sensors and broadcast data. In STEP 602, configuration data and/or models (i.e., data corresponding to landing equipment that affects L/D, such as aircraft landing gear data, aircraft flap data, and aircraft maneuver data) are also retrieved from memory 107 or determined from avionics data. Configuration data and/or models may be uploaded once or may be altered in the course of process 600, according to user input data received at user input device 101.

In STEP 604, processor 102 has the required data, and process 600 processes the data to determine a predicted landing site for various alterations of the lift-to-drag ratio that may be predetermined aircraft configurations. In the exemplary embodiment, process 600 predicts landing sites for three predetermined configurations: 1) a best or "clean" glide (first) landing site, 2) a second landing site that would result from a first alternate aircraft configuration (with a first alteration in L/D), and 3) a third landing site that would result from a second alternate aircraft configuration (with a second alteration in L/D). For example, in the exemplary embodiment, the first alternate aircraft configuration may be deploying only the landing gear, and the second alternate aircraft configuration may be deploying the landing gear and the flaps.

In STEP 606, the predicted landings sites are indicated using optionally selectable cue symbols (see, FIG. 2-FIG. 5, symbol 210, symbol 214 and symbol 218) that are displayed in perspective form on the landscape 202. Any user selected visual distinguishability, text, and symbol selection is incorporated into the display of the conformal configuration cues in STEP 606. At STEP 608, process 600 determines whether or not the aircraft has landed. If the aircraft has not landed, process 600 continuously cycles and updates display 106 until the aircraft has landed.

Thus, there has been provided a system and method for displaying predictive cues on an aircraft display system for executing a landing after an engine failure. The system and method displays the cues for various aircraft configurations, and each cue is displayed in perspective (conformally) on a three dimensional graphical display of the surrounding terrain.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A method for displaying, on an avionics display system, cues for executing an aircraft landing after an engine failure, the method comprising:

receiving avionics data;

processing the avionics data to (i) determine a current aircraft configuration, (ii) predict a first landing site based on the current aircraft configuration, (iii) predict a second landing site associated with altering the current aircraft configuration; and displaying a first cue representative of the first landing site and a second cue representative of the second landing site.

2. The method of claim 1, wherein altering the aircraft configuration comprises altering the lift-to-drag ratio.

3. The method of claim 2, wherein altering the lift-to-drag ratio comprises extending landing gear.

4. The method of claim 2, wherein altering the lift-to-drag ratio comprises extending landing gear and deploying flaps.

5. The method of claim 2, wherein altering the lift-to-drag ratio comprises deploying flaps.

6. The method of claim 2, wherein altering the lift-to-drag ratio comprises an aircraft maneuver.

7. The method of claim 1, wherein the step of displaying a cue comprises rendering the cue in perspective form at its predicted location on the terrain.

8. The method of claim 7, wherein the step of displaying further comprises displaying a chevron.

9. The method of claim 1, further comprising:

receiving user input data; and altering, by a processor, aircraft configuration data according to the user input data.

10. An avionics display system comprising:

a flight deck display coupled to receive display commands and configured, upon receipt thereof, to render images; and a processor operatively coupled to the flight deck display and adapted to receive avionics data, the processor configured, upon receipt of the avionics data, to:

(i) determine current aircraft configuration, (ii) determine aircraft body mass acceleration, (iii) predict a first landing site based on the current aircraft configuration, (iv) predict a second landing site associated with an alternate aircraft configuration, and (v) supply display commands to the flight deck display that cause the flight deck display to render a first cue representative of the first landing site and a second cue representative of the second landing site.

11. The system of claim 10, wherein the alternate aircraft configuration comprises a modification in the lift-to-drag ratio.

12. The system of claim 11, wherein the modification in the lift-to-drag ratio comprises extended landing gear.

13. The system of claim 11, wherein the modification in the lift-to-drag ratio comprises extended landing gear and deployed flaps.

14. The system of claim 11, wherein the modification in the lift-to-drag ratio comprises an aircraft maneuver.

15. The system of claim 10, wherein the avionics display system comprises a synthetic vision display.

16. The system of claim 10, wherein the processor is further configured to display each cue at its predicted location in perspective form on the terrain.

17. The system of claim 10, wherein each cue is a chevron and each chevron is oriented to point at the associated predicted landing site.

18. A method for displaying, on an avionics display system, configuration cues for executing a single engine aircraft landing after engine failure, the method comprising:

receiving avionics data;

processing the avionics data to (i) determine the terrain, (ii) determine current aircraft lift-to-drag ratio, (iii) predict a first landing site based on the current aircraft lift-to-drag ratio, (iv) predict a second landing site associated with a first alteration in the aircraft lift-to-drag ratio, and (v) predict a third landing site associated with a second alteration in the aircraft lift-to-drag ratio; and displaying (i) the terrain, (ii) a first cue representative of the first landing site, (iii) a second cue representative of the second landing site, and (iv) a third cue representative of the third landing site.

19. The method of claim 18, wherein displaying a cue comprises rendering the cue in perspective form at its predicted location on the terrain.

20. The method of claim 18, wherein the avionics display system is a synthetic vision system.

* * * * *